US012758862B2

(12) United States Patent
Callaway

(10) Patent No.: US 12,758,862 B2
(45) Date of Patent: Oct. 13, 2026

(54) SYSTEM AND METHOD FOR A PORTABLE GAMING TABLE

(71) Applicant: Preston Callaway, Princeton, TX (US)

(72) Inventor: Preston Callaway, Princeton, TX (US)

( * ) Notice: Subject to any disclaimer, the term of this patent is extended or adjusted under 35 U.S.C. 154(b) by 574 days.

(21) Appl. No.: 18/102,593

(22) Filed: Jan. 27, 2023

(65) Prior Publication Data

US 2023/0233926 A1 Jul. 27, 2023

Related U.S. Application Data

(60) Provisional application No. 63/303,863, filed on Jan. 27, 2022.

(51) Int. Cl.

| | |
|---|---|
| ***A63D 15/00*** | (2006.01) |
| ***A63D 15/04*** | (2006.01) |
| ***A63F 7/06*** | (2006.01) |
| ***A63F 7/36*** | (2006.01) |

(52) U.S. Cl.

CPC ..... *A63F 7/36* (2013.01); *A63D 15/04* (2013.01); *A63F 7/0632* (2013.01); *A63D 2015/001* (2013.01); *A63F 2007/3688* (2013.01)

(58) Field of Classification Search

CPC ..... A63D 15/04; A63D 2015/001; A63F 2007/3688

USPC ..... 473/4

See application file for complete search history.

(56) References Cited

U.S. PATENT DOCUMENTS

| | | | | |
|---|---|---|---|---|
| 3,782,748 | A * | 1/1974 | Poland | B62D 21/14 280/47.131 |
| 3,988,021 | A * | 10/1976 | Grover | A47B 25/00 473/15 |
| 5,839,966 | A * | 11/1998 | Eisenhauer | A63D 15/00 473/29 |
| 6,857,968 | B2 * | 2/2005 | Fallack | A63D 15/00 473/33 |
| 7,163,214 | B1 * | 1/2007 | Bratton, Sr. | B62B 5/0083 473/4 |
| 11,602,964 | B2 * | 3/2023 | Wiegel | B66F 3/20 |
| 11,691,658 | B2 * | 7/2023 | Delgatty | B62B 5/0013 180/65.51 |
| 2023/0233926 | A1 * | 7/2023 | Callaway | A63D 15/00 473/4 |

* cited by examiner

*Primary Examiner* — Mitra Aryanpour

(74) *Attorney, Agent, or Firm* — Goodhue, Coleman & Owens, P.C.

(57) ABSTRACT

A portable gaming system has a gaming table attached to a vehicular trailer. The trailer includes at least one axle and two wheels and a hitch for attaching to a vehicle. The trailer further includes a plurality of adjustable legs, wherein at least one of the plurality of adjustable legs is separately adjustable for leveling a tabletop of the gaming table. In addition, the gaming table includes a plurality of leveling mechanisms for leveling the tabletop. A plurality of level indicators is positioned on the tabletop to measure a level of the tabletop when adjusting the plurality of level mechanisms and the one or more adjustable legs.

20 Claims, 15 Drawing Sheets

Side View

Bottom View of Trailer

Side View

Top View

Bullseye Level

Bar Level

Cross-Section Side View

Side View of Automatic Leveling Trailer

Side View of Trailer with Cover

Side View of Trailer with Ping Pong Top

SYSTEM AND METHOD FOR A PORTABLE GAMING TABLE

CROSS REFERENCE TO RELATED APPLICATIONS

This application claims priority to prior U.S. Provisional Application No. 63/303,863 filed on Jan. 27, 2022, which is hereby incorporated by reference herein.

FIELD

This application relates to portable gaming tables and more particularly, to a portable gaming table system with a trailer and leveling system.

BACKGROUND

The game of pool, also called billiards, is very popular but requires a pool table. Pool tables are expensive, bulky, and difficult to move and install. For example, pool tables are heavy and so frequent movement is undesirable. In addition, a pool table is susceptible to damage while being moved between locations. Pool tables are also difficult to level when installing. These detriments prevent rental or temporary use of pool tables at a location. Other types of gaming tables, such as ping pong tables, air hockey tables, shuffleboard tables and other type of gaming tables, have similar issues. Accordingly, there is a need for a gaming table that is easily transported and installed between various locations.

SUMMARY

In one aspect, a portable gaming system includes a gaming table including a tabletop and a trailer attached to the gaming table. The trailer includes at least one axle and two wheels, a hitch, and a plurality of supports, wherein a height of one or more of the plurality of supports is adjustable for leveling the tabletop of the gaming table.

In another aspect, a portable gaming system includes a gaming table including a tabletop and box support, at least two wheels coupled to the box support, and a hitch coupled to the box support. A plurality of adjustable legs are coupled to the box support, wherein the plurality of adjustable legs are separately adjustable for leveling the tabletop of the gaming table.

In another aspect, a portable gaming system includes a gaming table including a tabletop and box support, wherein the box support includes a top support fixedly coupled to the tabletop and a bottom support. A plurality of level mechanisms couple the top support and the bottom support, wherein each of the plurality of level mechanisms is separately adjustable to increase or decrease a distance between the top support and the bottom support. The portable gaming system also includes a vehicular trailer attached to the box support, wherein the trailer includes at least one axle and two wheels, a hitch, and a plurality of adjustable legs, wherein the plurality of adjustable legs is each separately adjustable for leveling the tabletop of the gaming table.

In one or more of the above aspects, the gaming table further comprises a plurality of leveling mechanisms for leveling the tabletop.

In one or more of the above aspects, the gaming table includes a bottom support for the gaming table, wherein the bottom support is coupled to the trailer and a top support fixedly coupled to the tabletop. A plurality of level mechanisms couple the top support and the bottom support, wherein each of the plurality of level mechanisms is separately adjustable to increase or decrease a distance between the top support and the bottom support.

In one or more of the above aspects, the bottom support for the gaming table is detachably coupled to the trailer.

In one or more of the above aspects, a level mechanism includes a bolt with threads reversed from each end, wherein the bolt pulls a portion of the top support a closer distance to the bottom support when rotated in a first direction and pushes the portion of the top support a further distance from the bottom support when rotated in a second direction.

In one or more of the above aspects, a plurality of level indicators is positioned on the tabletop. The plurality of level indicators determine a level for the tabletop for adjusting the plurality of level mechanisms and the height of the one or more of the plurality of supports.

In one or more of the above aspects, a hitch is integrated with a crossbar that is attached to the trailer. The hitch is configured to attach to a vehicle for towing of the trailer. The trailer may also include a track for sliding the hitch under the trailer.

In one or more of the above aspects, the tabletop includes at least one of: a pool tabletop, air hockey tabletop or a shuffle board tabletop.

In at least one or more of the above aspects, the portable gaming system includes a level controller including at least one processing circuit and at least one memory device, wherein the at least one memory device stores instructions that, when executed by the at least one processing circuit, causes the portable gaming system to determine level data from the plurality of level indicators and automatically adjust one or more of the plurality of level mechanisms and/or the height of the one or more of the plurality of supports in response to the level data.

In at least one or more of the above aspects, the plurality of supports includes at least four legs, wherein each one of the four legs includes a scissor jack for independently raising and lowering a height of the respective one of the four legs.

In at least one or more of the above aspects, the plurality of supports includes at least two legs, wherein each one of the two legs is hingedly coupled to the trailer and independently extendable to different heights.

In at least one or more of the above aspects, the gaming table further comprises a plurality of leveling mechanisms for leveling the tabletop.

In at least one or more of the above aspects, the box support includes a bottom support, wherein the bottom support is coupled to the plurality of adjustable legs and a top support fixedly coupled to the tabletop. A plurality of level mechanisms couple the top support and the bottom support, wherein each of the plurality of level mechanisms is separately adjustable to increase or decrease a distance between the top support and the bottom support.

In one or more of the above aspects, a plurality of level indicators are positioned on the tabletop, wherein the plurality of level indicators measures a level of the tabletop for adjusting the plurality of level mechanisms and the plurality of adjustable legs.

DETAILED DESCRIPTION

The word "exemplary" or "embodiment" is used herein to mean "serving as an example, instance, or illustration." Any implementation or aspect described herein as "exemplary" or as an "embodiment" is not necessarily to be construed as preferred or advantageous over other aspects of the disclosure. Likewise, the term "aspects" does not require that all aspects of the disclosure include the discussed feature, advantage, or mode of operation.

Embodiments will now be described in detail with reference to the accompanying drawings. In the following description, numerous specific details are set forth in order to provide a thorough understanding of the aspects described herein. It will be apparent, however, to one skilled in the art, that these and other aspects may be practiced without some or all of these specific details. In addition, well known steps in a method of a process may be omitted from flow diagrams presented herein in order not to obscure the aspects of the disclosure. Similarly, well known components in a device may be omitted from figures and descriptions thereof presented herein in order not to obscure the aspects of the disclosure.

Figure 1:
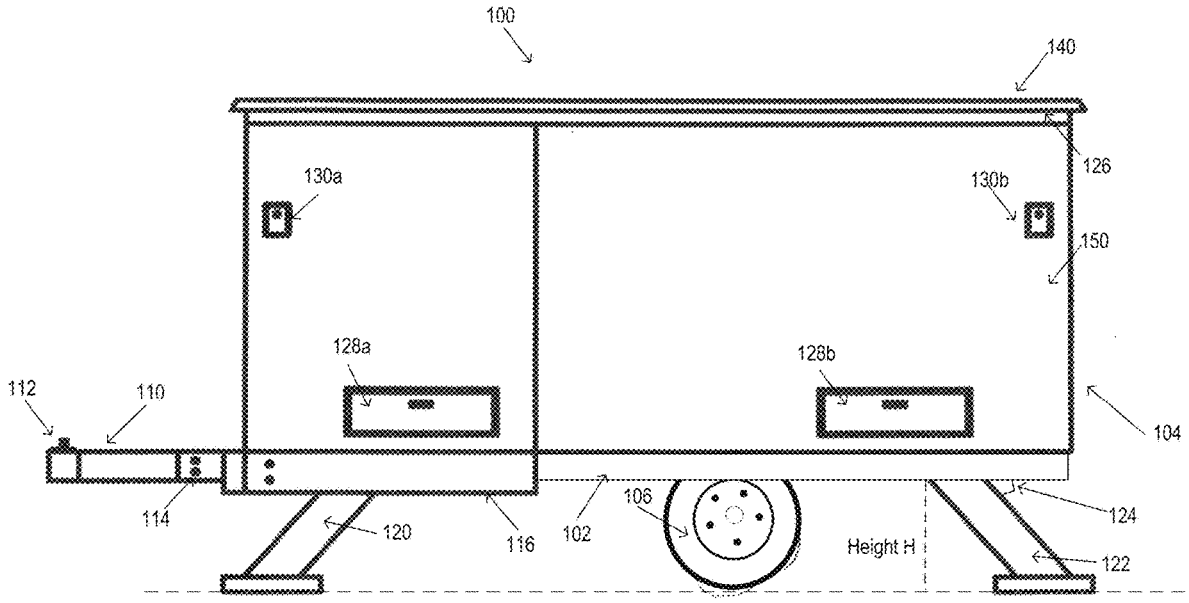
FIG. 1 illustrates an embodiment of a side elevation view of a portable pool table system.

FIG. 1 illustrates an embodiment of a side elevation view of a portable pool table system 100. The pool table system 100 includes a trailer 102 with an attached or integrated pool table 104. In this embodiment, the trailer 102 includes a single axle with two wheels 106 but may include two axles with four wheels 106. The two wheels 106 may be attached to the trailer separately, e.g., using torsional stub axles. The trailer 102 includes a trailer hitch 112 fixedly attached to a crossbar 110 for towing the trailer 102 by a vehicle, e.g. on a street, highway, etc. A hitch jack (not shown) may be integrated into the crossbar 110 to elevate and release the hitch 112 from the vehicle. In addition, the crossbar 110 includes a release mechanism 114, such as bolts or pins. The release mechanism 114 disengages the crossbar 110 to slide or fold under the trailer 102 into the hitch cover 116. The hitch cover 116 may include pins or screws to hold the crossbar 110. In another embodiment, the release mechanism 114 may unfasten the crossbar 110 from the trailer 102. The crossbar 110 and hitch 112 may then be removed and stowed during use of the pool table.

The pool table 104 includes the tabletop 140 and box support 150. The box support 150 may include one or more ball returns 128*a-b* and level gauges 130*a-b*. The portable pool table system 100 includes one or more methods for leveling the tabletop 140. First, the trailer 102 includes two support legs 120, 122 that are configured to adjustably extend from a bottom portion of the trailer 102 to the ground. In an embodiment, the support legs 120, 122 are configured to be stowed under the trailer 102 and then to be released and extend to a height H from the trailer 102 to the ground. In one example, at least one of the two legs may be adjusted to varying heights H. For example, one or more of the support legs 120, 122 may be adjusted using a ratchet or screw lift system, hydraulic lift system, mechanical lift, or other type of system to varying and/or different heights H. The heights of the one or more support legs may be adjusted to help level the tabletop 140. Preferably, the support legs 120, 122 extend such that the tabletop 140 is at least a height of 31 inches to 33 inches.

One or more level indicators 210*a-d* (shown in FIG. 2) may be referenced when adjusting the heights of the one or more support legs 120, 122. After extension of the support legs 120, 122 to a same or different heights H, the wheels 106 may be elevated off the ground or may remain touching the ground but without rotation. Though two support legs 120, 122 are shown in FIG. 1 as an example embodiment, four support legs may be implemented wherein one or more of the four legs has an adjustable height, or a single central support may be implemented instead.

Another, second method for leveling the tabletop 140 includes a plurality of leveling mechanisms that are accessible through openings 130*a*, 130*b* formed in the enclosure of the box support 150. The leveling mechanisms are configured to adjust a level of the tabletop 140 independently of the trailer 102, as explained in further detail herein. The box support 150 further includes a flexible strip 126, such as rubber or foam, that lies between the box support 150 and tabletop 144. The flexible strip 126 may be compressed by the tabletop 140 or may expand to support the tabletop 140 as the tabletop 140 is leveled.

The height of the trailer 102 with the extended support legs 120, 122 from the ground to the tabletop 140 is preferably the standard height of a pool table, between 2 ft 9.5 in and 2 ft 10.5 in. However, shorter, or taller heights may be implemented in different models or for different sized tables.

Figure 2:
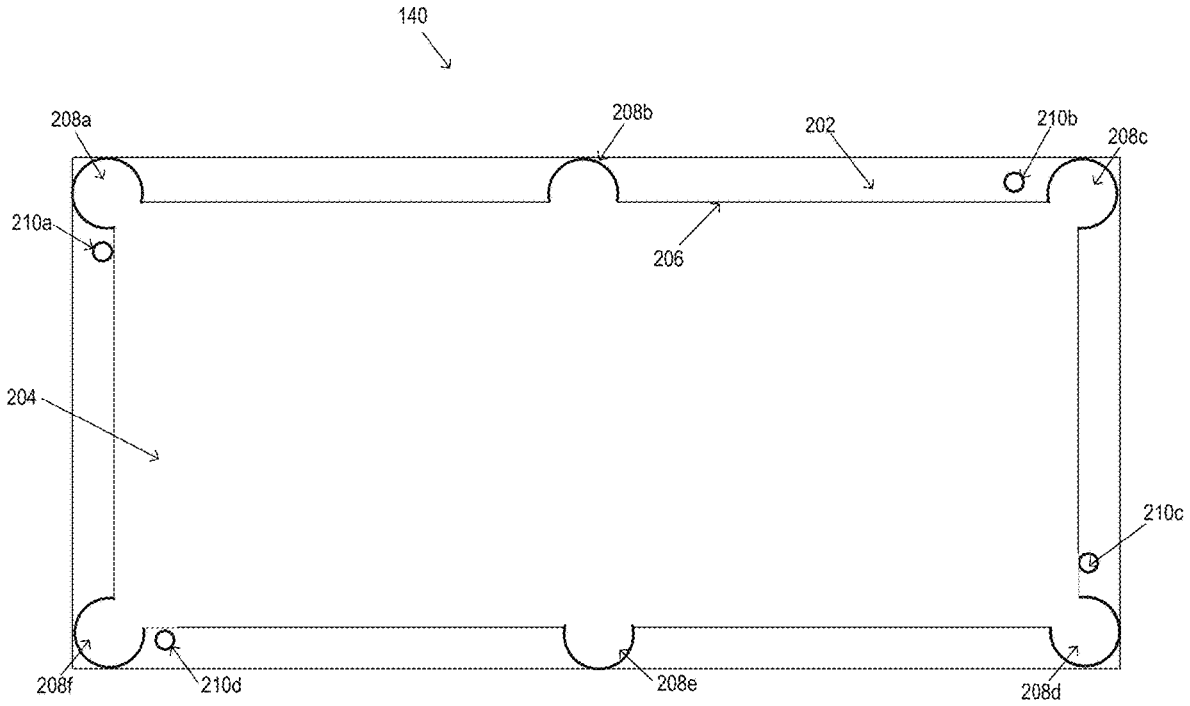
FIG. 2 illustrates an embodiment of a top plan view of the portable pool table system.

FIG. 2 illustrates an embodiment of a top plan view of the tabletop 140 of the portable pool table system 100. The tabletop 140 includes a rail 202 and playing field 204 that form a plurality of pockets 208*a-f*. The rail 202 forms a short wall or bumper 206 around the perimeter of the playing field 204 that keeps the balls on the playing surface. The bumper 206 is faced with a rubber cushion so balls that strike it rebound predictably and remain in play.

The pockets 208*a-f* may be lined with netting or other material that holds and supports the balls within the pockets 208*a-f*. In another embodiment, a tubing system (not shown) may guide the balls from the pockets 208*a-f* to one or more ball return openings 128*a*, 128*b* in the box support 150.

The playing field 204 is typically constructed using slate and covered in a felt material. However, slate is more susceptible to breaking or cracking and may not be sufficiently durable for the portable pool table system 100. Thus, the playing field 204 may instead comprise wood (such as aviation pilot plywood), steel, fiberglass, plexiglass, or other materials. When a slate material is preferred, the tabletop 140 may include extra cushioning, such as air bags, foam, rubber and/or other protective measures to help prevent cracking. The rail 202 may be formed of wood, fiberglass, plexiglass, tempered aluminum, or other material. Felt or other suitable material may then cover the playing field 204 and bumpers 206.

Figure 3A:
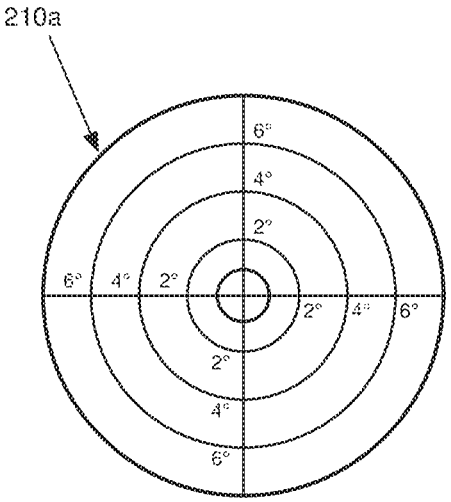
FIG. 3A and FIG. 3B illustrate embodiments of level indicators of the portable pool table system.
Figure 3B:
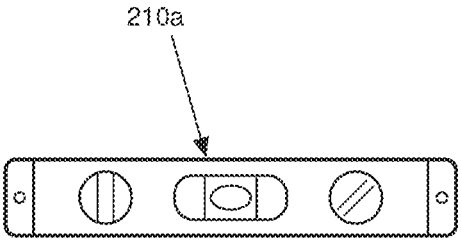

The tabletop 140 further includes a plurality of level indicators 210*a-d*. As shown in FIG. 3A and FIG. 3B, the level indicators 210*a-d* may include one or more of bullseye levels, bar levels or other type of level indicators. The level indicators 210 are used as guides to level the tabletop 140. In an embodiment, the level indicators 210 are positioned at or approximately close to corners of the tabletop 140. However, in other embodiments, one or more of the level indicators 210 may be positioned elsewhere on the tabletop 140, such as along the sides of the rails or at the outer edges of the tabletop 140.

The size of the tabletop 140 may vary depending on the use of the pool table 104, the desired model, location, etc. Below is a list of standard sizes that may be implemented:

12-ft (snooker): 140" (356.9 cm)×70" (177.8 cm)

10-ft (oversized): 112" (284.5 cm)×56" (142.2 cm)

9-ft (standard regulation size table): 100" (254 cm)×50" (127 cm)

8-ft+(pro 8): 92" (233.7 cm)×46" (116.8 cm)

8-ft (typical home table): 88" (223.5 cm)×44" (111.8 cm)

7-ft+(large "bar box"): 78-82" (198.1-208.3 cm)×39-41" (99.1-104.1 cm)

7-ft ("bar box"): 74-78" (188-198.1 cm)×37-39" (94-99.1 cm)

6-ft ("small bar box"): 70-74" (177.8-188 cm)×35-37" (88.9-94 cm)

These dimensions are exemplary, and other dimensions for the tabletop 140 may be implemented as well. The size of the trailer 102 may be varied to accommodate the desired dimensions of the tabletop 140. And box support 150

Figure 4:
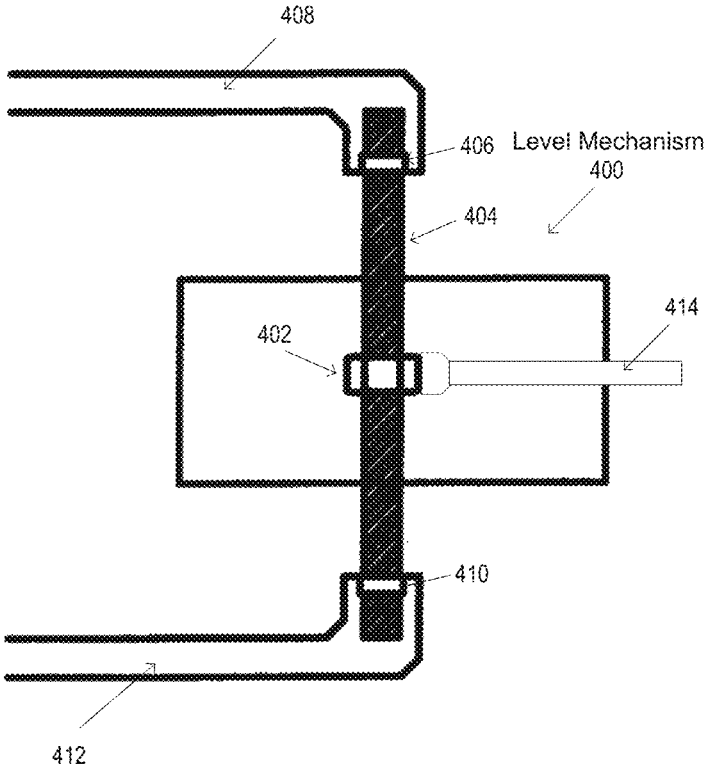
FIG. 4 illustrates an embodiment of a cross-section of the portable pool table system showing one of a plurality of level mechanisms.

FIG. 4 illustrates an embodiment of a cross-section of the box support 150 showing one of a plurality of level mechanisms 400. The tabletop 140 is fixedly coupled to a top support 408. The bottom support 410 is fixedly coupled to the trailer 102. The top support 408 for the tabletop 140 is adjustably coupled to the bottom support 412 via one or more level mechanisms 400. The level mechanism 400 adjusts the distance between the top support 408 and the bottom support 412 at different points of attachment.

In this embodiment shown in FIG. 4, the level mechanism 400 includes a bolt 404 with a central nut 402. The bolt 404 is secured to the top support 408 by a top nut 406, and the bolt 410 is secured to the bottom support 412 by a bottom nut 410. The bolt 404 has threads in a first direction at nut 406 and reversed threads in a second direction at nut 410. A central nut 402 engages a ratchet 414. When the ratchet 414 is turned in a first direction, the bolt 404 turns within top nut 406 and bottom nut 410 to pull a portion of the top support 408 towards the bottom support 412. The distance between the top support 408 and bottom support 412 then decreases along the bolt 410. When the ratchet 414 is turned in a second direction, the bolt 404 turns within top nut 406 and bottom nut 410 to push the top support 408 further apart from the bottom support 412 at that point. The distance between the top support 408 and bottom support 412 then increases along bolt 410. The level of the tabletop 140 may thus be adjusted using one or more of these level mechanisms 400. Though a bolt and nut mechanism is described herein, an hydraulic lift system or gear system or other type of level mechanism may be implemented within the portable pool table system 100.

Figure 5A:
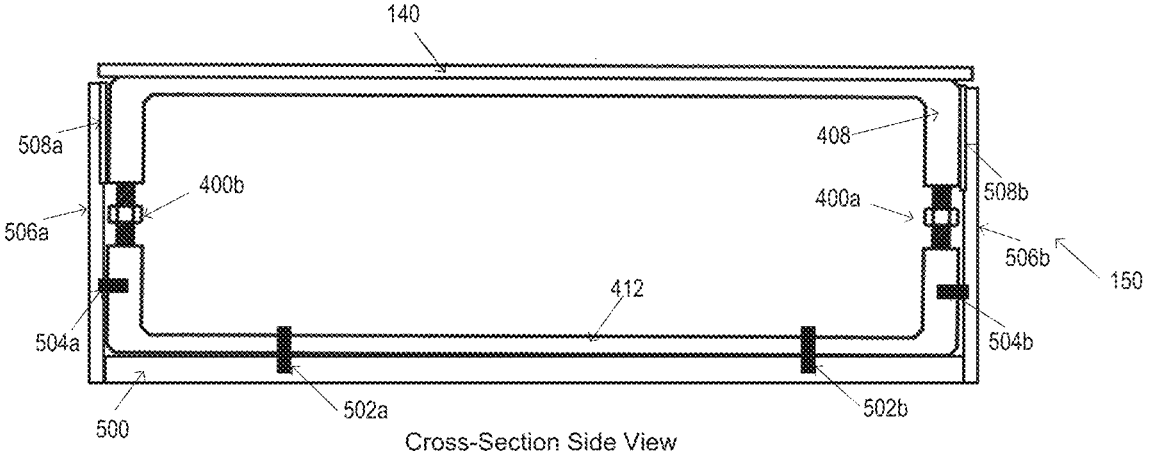
FIG. 5A illustrates an embodiment of a cross-section of the portable pool table system.

FIG. 5A illustrates an embodiment of a cross-section of the box support 150 of the portable pool table system 100. In an embodiment, the plurality of level mechanisms 400 couple the top support 408 to the bottom support 412 of the pool table 104 at a plurality of points. For example, four level mechanisms 400 may be positioned at each corner between the top support 408 and the bottom support 412. In another example, four level mechanisms 400 are positioned at a center of each side between the top support 408 and the bottom support. In another example, only two level mechanisms are positioned at two diagonally opposing corners. Other configurations may also be implemented. The level mechanisms adjust a distance of its respective connection point or portion of the top support 408 to the bottom support 412.

The level mechanisms 400 are adjusted until the level indicators 210*a-d* of the tabletop 140 indicate that the tabletop 140 is level or at least within a desired level range (e.g., 0-2 degrees of a bullseye level).

In an embodiment, the pool table 104 is fixedly coupled with respect to the trailer 102. For example, a first plurality of bolts 502*a*, 502*b* or other attachment mechanisms fixedly couple the box support 150 to a bottom portion 500 of the trailer 102. In another embodiment, the box support 150 for the tabletop 140 is detachably coupled to the trailer 102, e.g. using clamps or other mechanisms, rather the bolts 502*b*. The trailer 102 may thus be used for other purposes or the pool table 104 may be used separately from the trailer 102.

In the box support 150, one or more bolts 504*a* or other attachment mechanisms fixedly couple the bottom support 412 to a first front side portion 506*a*. One or more other bolts 504*b* or other attachment mechanisms fixedly couple the bottom support 412 to a second, end side portion 506*a*. Though FIG. 5A illustrates that the bottom support 412 is lays adjacent to the trailer 102, one or more components may lay therebetween, such as a flexible layer, braces, support layer, or other framing, etc.

In contrast to the bottom support 412, the top support 408 is adjustable with respect to the trailer 102, e.g., via the plurality of level mechanisms 400. The tabletop 140 may be adjusted or leveled independently of the trailer 102. Thus, the top support 408 is not fixedly coupled with respect to the trailer 102 but may have a different level than the trailer 102 or bottom support 412.

A flexible layer 508*a*, 508*b* may be positioned between the top support 408 and side portions 506*a*, 506*b*. During leveling, the flexible strip 126 may be compressed by the top support 408 and/or tabletop 140 or may expand to support the top support 408 and/or tabletop 140 as the tabletop 140 is adjusted with respect to the trailer 102. One or more other components may lay between the top support 408 and/or tabletop 140 and the trailer 102, however such components do not fixedly couple the trailer 102 to the top support 408 or otherwise hinder the adjustment or leveling of the tabletop 140.

Figure 5B:
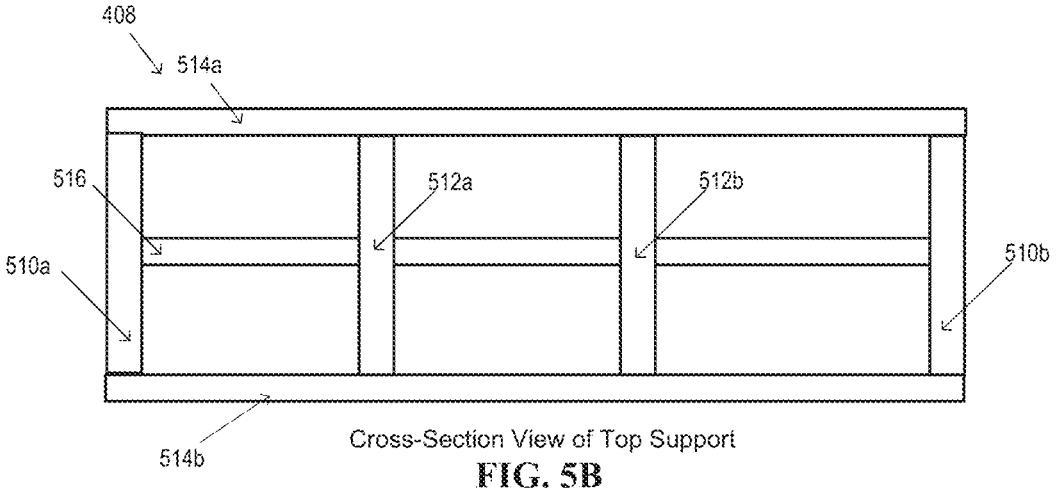
FIG. 5B illustrates an embodiment of a cross-section of the top support of the portable pool table system.

FIG. 5B illustrates an embodiment of a top view of the top support 408 of the portable pool table system 100. As shown in FIG. 5B, the top support 408 may comprise a perimeter frame including frame members 510*a*, 510*b*, 514*a*, 514*b*. A center beam 516 may lay between frame members 510*a*, 510*b*, and one or more slats 512*a*, 512*b* may lay between frame members 514*a*, 514*b*. Other configurations of slats and cross beams may be implemented as well. The top support 408 is fixedly coupled to and supports the playing field 204 of the tabletop 140.

Figure 6:
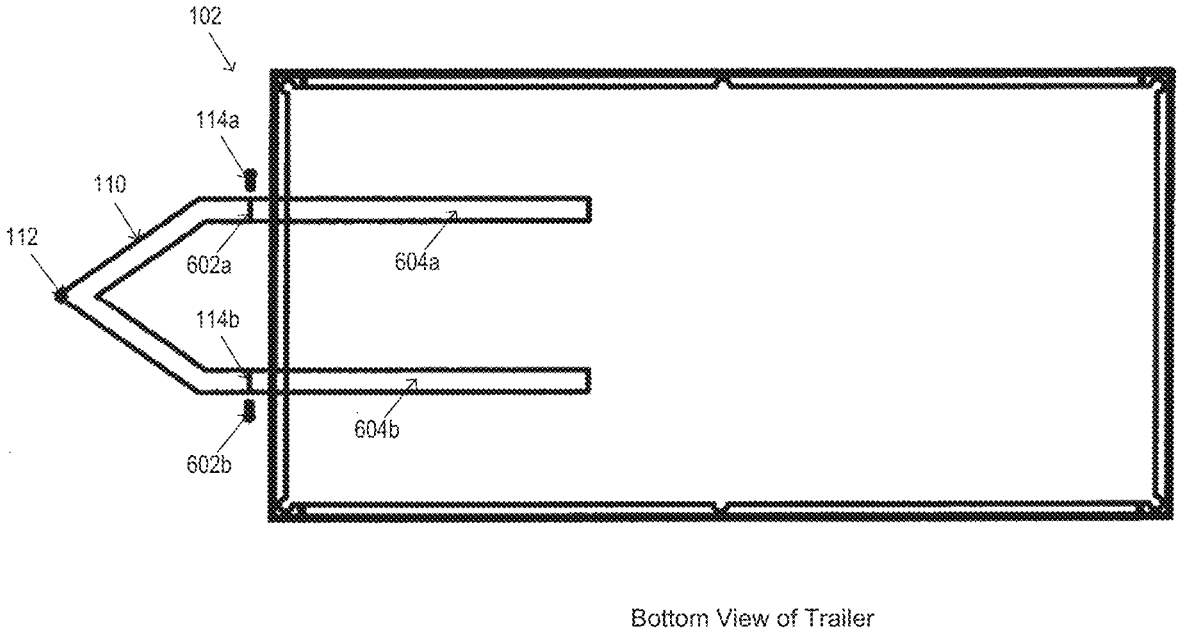
FIG. 6 illustrates an embodiment of a bottom cross sectional view of the portable pool table system.

FIG. 6 illustrates an embodiment of a bottom cross sectional view of the trailer 102 of the portable pool table system 100. The trailer hitch 112 is attached to the crossbar 110 for towing the trailer 102 by a vehicle. Release mechanisms 114*a*, 114*b* are included on the cross bar 110 to disengage the crossbar 110 such that it slides or folds under the trailer 102 along tracks 604*a*, 604*b*. Though two tracks are illustrated herein, the crossbar 110 may slide along one track or fold hingedly under the trailer. In another embodiment, the release mechanisms 114*a*, 114*b* may unfasten the crossbar 110 from the trailer 102 such that the crossbar 110 and hitch 112 may be removed and stowed during use of the pool table 104. The axle and wheels 106 are also attached to the trailer 102.

Figure 7:
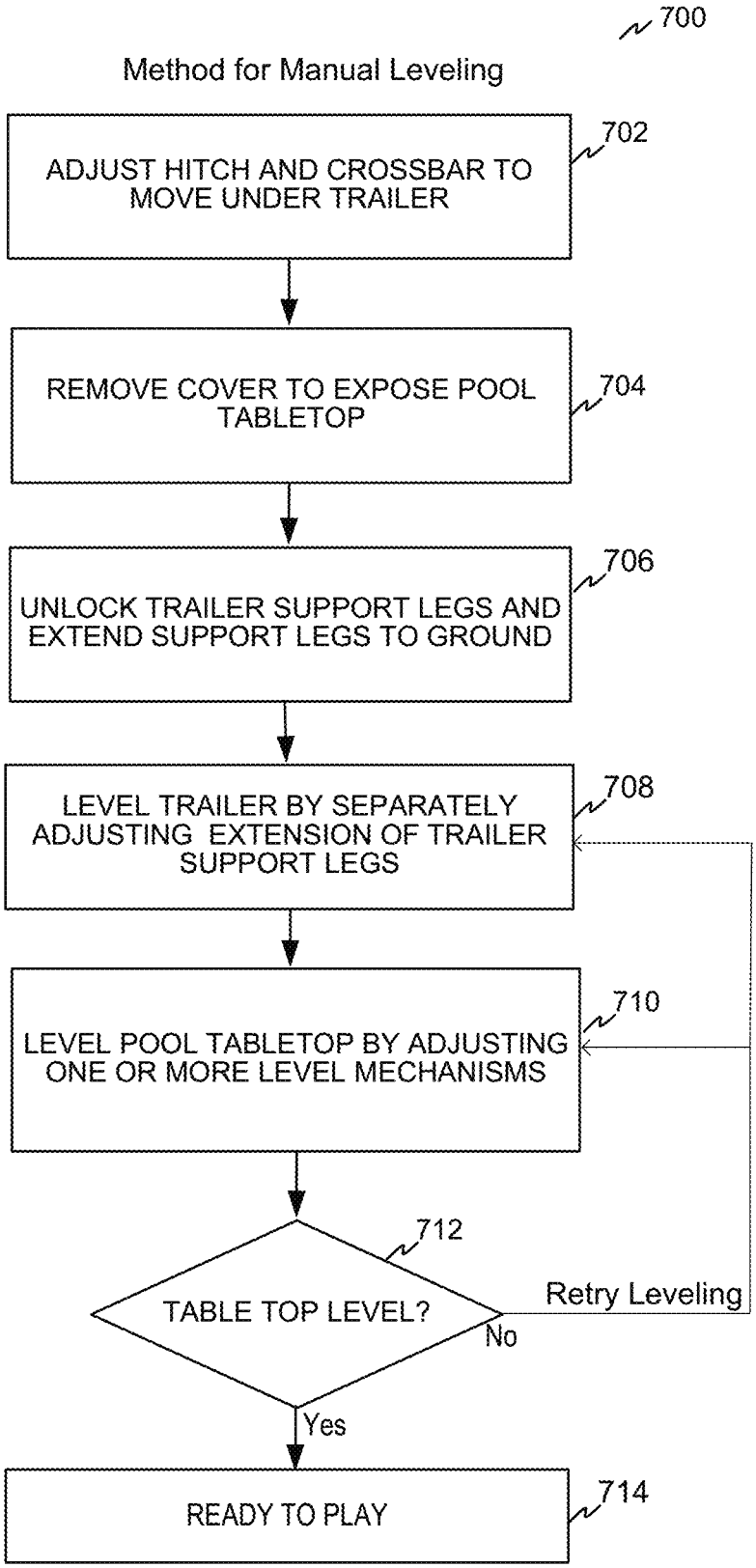
FIG. 7 illustrates an embodiment of a method for manual leveling of the portable pool table system.

FIG. 7 illustrates an embodiment of a method 700 for manual leveling of the portable pool table system 100. In use, the trailer 102 may be towed to a desired location and unhitched from the vehicle using an integrated hitch jack. The crossbar 110 is disengaged, e.g. using the release mechanisms 114*a*, 114*b*, and slid under the trailer 102 or removed at 702. The pool table 104 further includes a cover (not shown) that provides a weatherproof protection to the pool tabletop 140. The cover is removable to expose the pool tabletop 140 at 704. A lock or release mechanism releases the trailer support legs 120, 122 that are then extended to the ground.

In a first step to level the tabletop 140, the height of different sides of the trailer 102 may be adjusted using the support legs 120, 122. For example, one or more of the support legs 120, 122 may be adjustably extended to different heights H. The heights H of the one or more support legs may then be adjusted using the one or more level indicators 210 as a guide at 708. Thus, the support legs 120, 122 may have different extensions and heights H with respect to the ground.

In a next step to level the tabletop 140, one or more of the level mechanisms 400 is adjusted using the one or more level indicators 210 as a guide at 710. The level indicators 210 are used to determine whether the tabletop 140, e.g. the playing surface 204, is level or within an acceptable range (such as 0-2 degrees of a bullseye level) at 712. For professional play, the flatness of the playing surface 204 must be divergent by no greater than 0.02 inches lengthwise and 0.01 inches across the width. Thus, the acceptable range in the level of the playing surface 204 may depend on the size of the playing surface 204 and the desired standard (professional or amateur). When the tabletop 140 is not within the desired range, the steps at 708 and/or 712 may be performed again until the playing surface 204 is within an acceptable range. The pool table is then ready to be used for play at 714.

Figure 8:
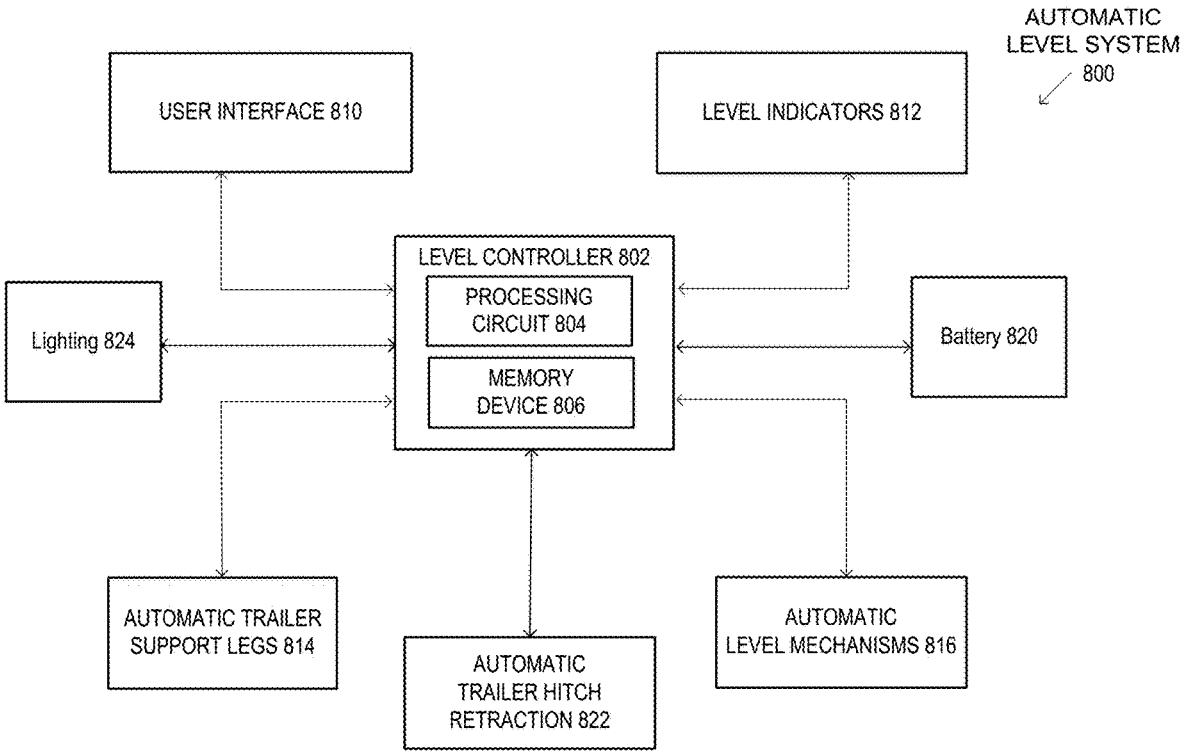
FIG. 8 illustrates an embodiment of a system for automatic leveling of the portable pool table system.

FIG. 8 illustrates an embodiment of a system for automatic leveling of the portable pool table system 100. A level controller 802 includes one or more processing circuits 804 communicatively coupled to one or more memory devices 806. In one aspect, the memory device 806 may include one or more non-transitory processor readable memories that store instructions which when executed by the one or more processing circuits 804 or other components of the portable pool table system 100, causes the one or more processing circuits 804 or other components to perform one or more functions described herein. The automatic level system 800 may be battery operated and include a battery 820. In an embodiment, the battery 210 is recharged using a power source of the vehicle or solar panels or a connection to an electrical outlet. In an embodiment, the battery may also power lighting 824 for the pool table system 100. For example, LED type lights may be located along the bumper 206 to light the tabletop 140 and/or around the trailer 102 to light around the tabletop 140.

The level controller 802 is configured to communicate with a user interface 810, such as a control panel integrated on the trailer 102, remote controller, smart phone, or another user device. The level controller 802 is operable to receive commands from the user interface 810 and to provide status updates to the user interface.

The level controller 802 is further configured to receive data from the plurality of level indicators 812. The level controller 802 may determine from the plurality of level indicators 812 whether the playing surface 204 is level. In response thereto, the level controller 802 is configured to adjust one or more automatic trailer support legs 814 and/or one or more automatic level mechanisms 816. For example, the level controller 802 may control a hydraulic gear to extend and/or retract one or more of the support legs with respect to the trailer 102. The level controller 802 may also control one or more of the level mechanisms 400 to adjust the level of the playing surface 204.

In an embodiment, the portable pool table system 100 may also include gears or hydraulic system to retract the trailer hitch 112 and crossbar 110 along the tracks 604. Thus, the system and methods for the trailer 102 to convert to a playable pool table are performed electronically without manual intervention.

Figure 9:
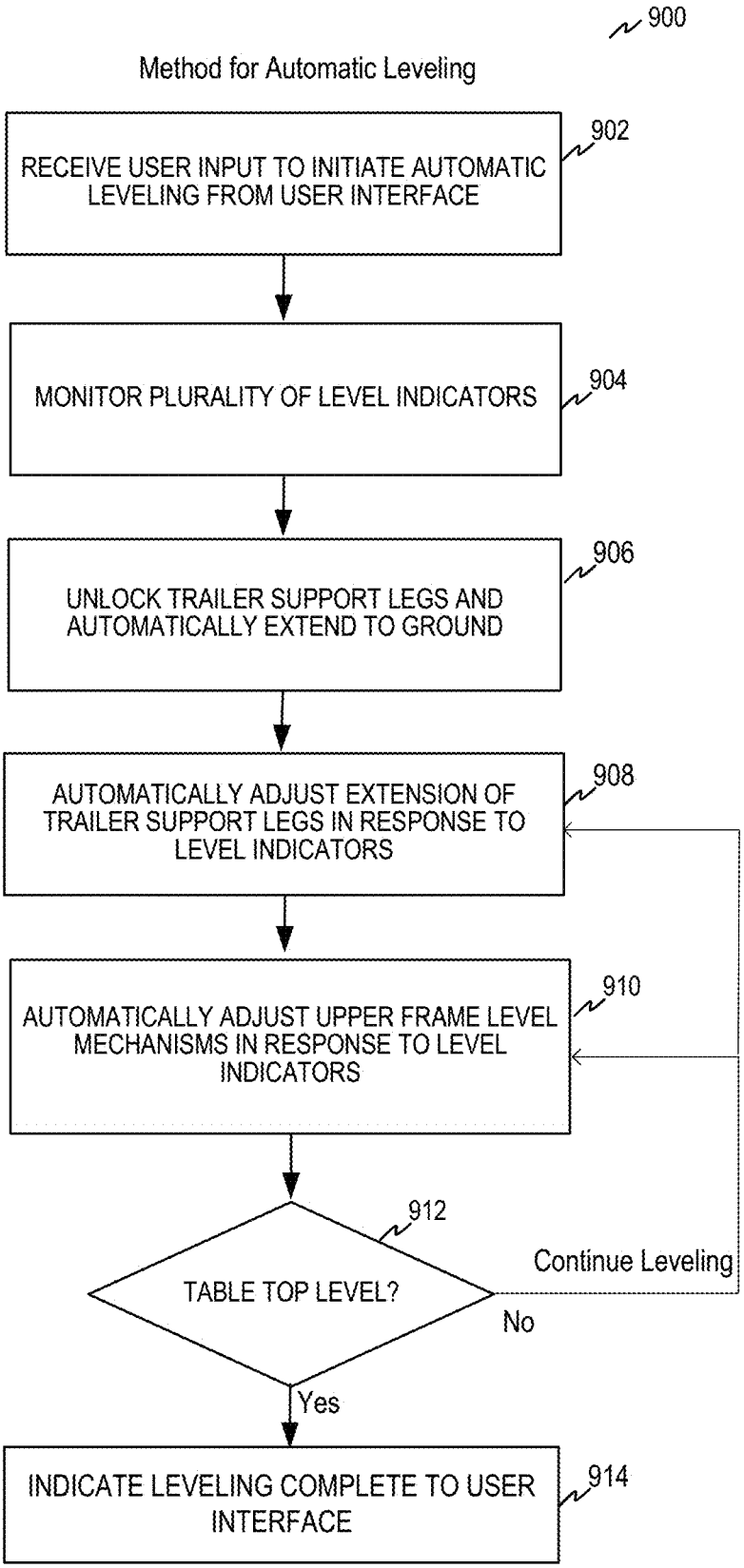
FIG. 9 illustrates an embodiment of a method for automatic leveling of the portable pool table system.

FIG. 9 illustrates an embodiment of a method 900 for automatic leveling of the portable pool table system 100. At 902, user input is received, e.g. from the user interface, to initiate automatic leveling. At 904, the level controller 802 monitors the plurality of level indicators 904 and receives level data. The support legs 120, 122 are unlocked and released automatically and extended to ground to a predetermined length. The predetermined length may be a minimum length to obtain a desired pool table height.

From the level data, the level controller 802 determines whether the one or more support legs 120,122 need to be adjusted at 908 and/or whether one or more level mechanisms 400 need to be adjusted at 910. The level controller 802 automatically performs such adjustments and continues to monitor the level indicators 210 at 912. If the tabletop 140 is still not level, the level controller 802 continues to determine how to adjust the pool table system 100 using the level indicators 210 and performs such adjustments. For example, when the levels indicate that the adjustments needed are greater than possible with the level mechanisms 400, then the extension of one or more of the leg supports 120, 122 is adjusted.

When fine adjustments are needed, then the adjustments are made using the one or more level mechanisms 400. The level controller 802 may also determine which of the plurality of level mechanisms 400 need adjustment based on the level indicators 210. For example, one level indicator 210 may show that one corner is level but three other level indicators 210 may show that the other three corners are not level. The level controller 802 may then adjust the three level mechanisms 400 located proximately to the unlevel corners. The level controller 802 may also determine from the level data the distance and direction to adjust the level mechanisms 400.

When the tabletop 140 is level at 912, the level controller 802 communicates to the user interface that leveling is complete. The user interface 810 provides an audible or visual signal to the user that the pool table 104 is level and ready to play. At any time thereafter, a user may input a command to automatically relevel the pool table.

Figure 10:
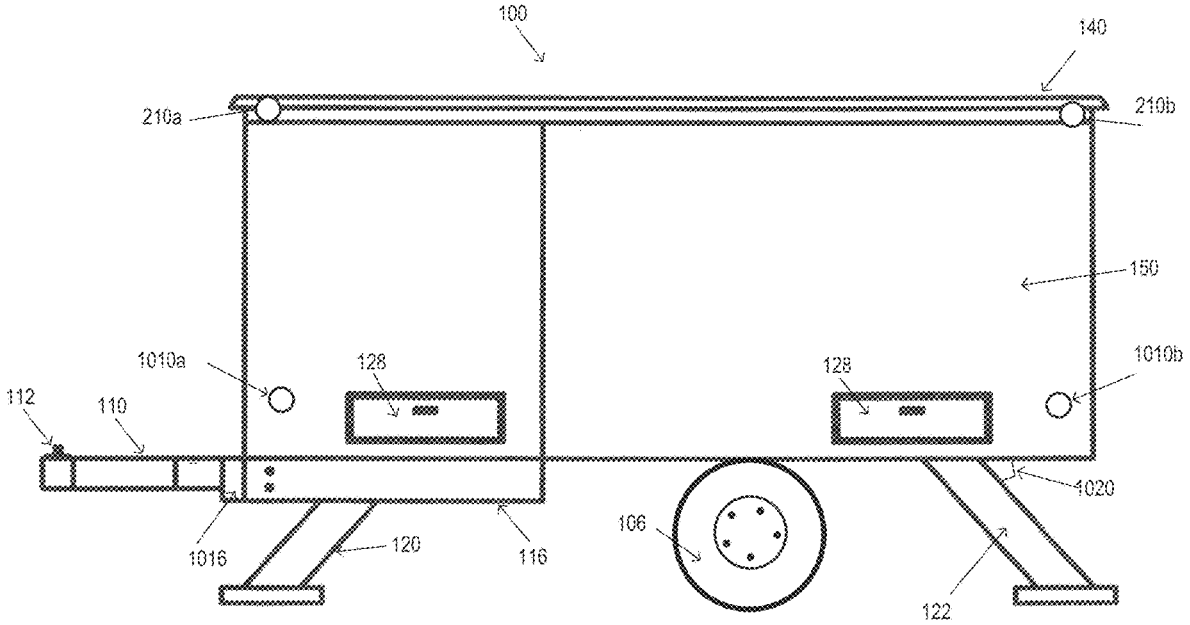
FIG. 10 illustrates another embodiment of a side elevation view of a portable pool table system with automatic leveling.

FIG. 10 illustrates another embodiment of a side elevation view of the portable pool table system 100 with a leveling system. In an embodiment, a first plurality of level indicators 210*a-d* is located in the tabletop 140 and a second plurality of level indicators 1010*a-b* are positioned in a bottom portion of the box support 150. The second plurality of level indicators 1010*a-b* may be used to determine an extension of the one or more of the support legs 120, 122.

In this embodiment, the hitch and crossbar 110 may be electronically slid under the trailer 102. For example, a motor 1016 may use gears or hydraulics to slide the crossbar along the tracks 604 into the cover 116 under the trailer 102. An electronic extender 1020 is attached to each support leg 120, 122. The electronic extender 1020 automatically extends or retracts the support legs 120, 122 and may comprise a motor/gear configuration, hydraulic slide, or other mechanism.

In an embodiment, the pool table system 100 may include one or more manual systems as described with respect to FIGS. 1 and 7, and one or more electronic systems as described in FIGS. 8-10. For example, the pool table system 100 may implement a manual mechanism to release pins 114 and slide the crossbar 110 along the tracks 604 under the trailer 102. The same embodiment may implement electronic leveling using automatic extension of the support legs 120, 122 and adjustment of the level mechanisms 400. In another embodiment, the extension of the legs 120, 122 is performed manually, e.g. using a ratchet, while the level mechanisms 400 are adjusted automatically using the level controller 802.

Figure 11:
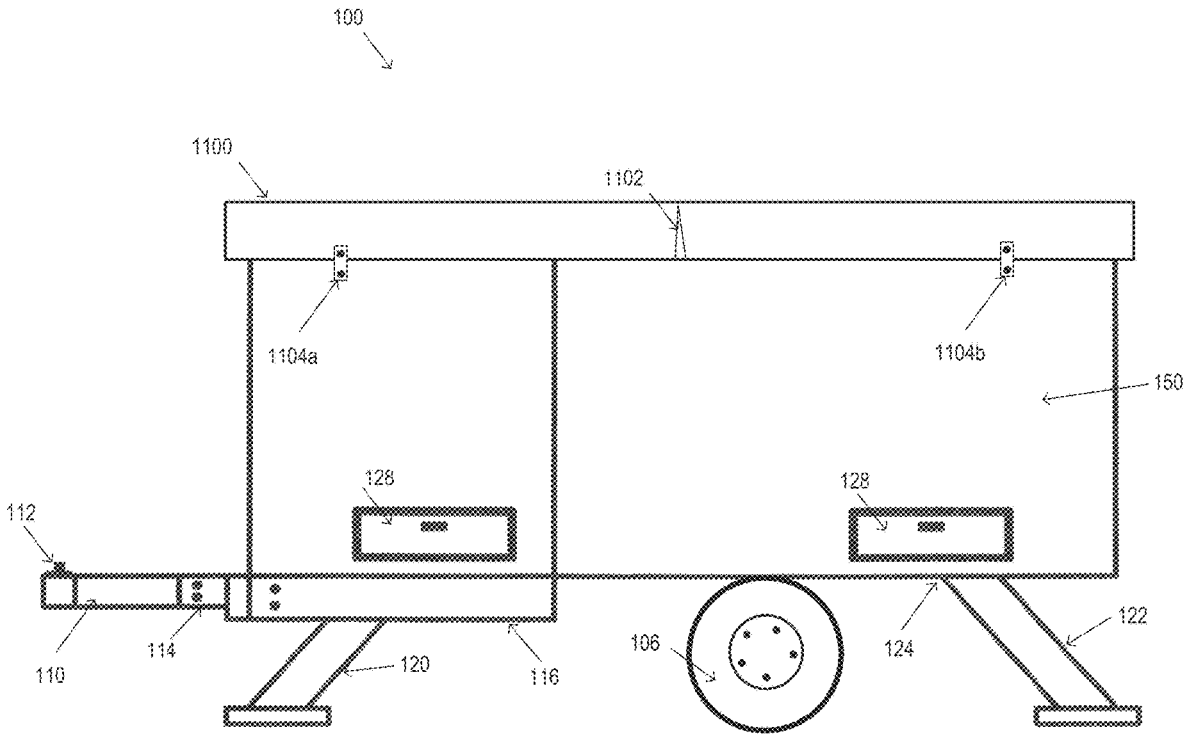
FIG. 11 illustrates an embodiment of a side elevation view of the portable pool table system with a cover.

FIG. 11 illustrates an embodiment of a side elevation view of the portable pool table system 100 with a cover 1100. The cover 1100 may include one or more folds 1102 for ease of installation and removal. The cover 1100 is secured to the box support 150 by one or more latches 1104*a*, 1104*b*. Preferably, the cover 1100 is weatherproof and leakproof to protect the tabletop 140.

Figure 12:
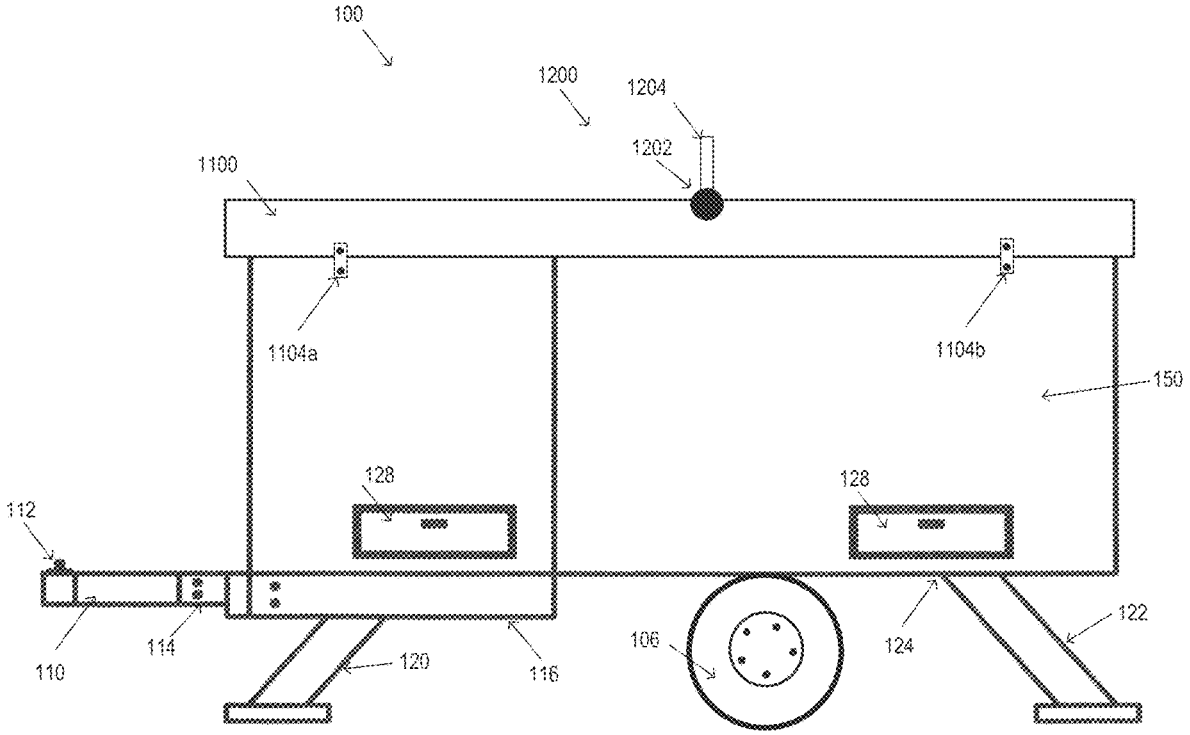
FIG. 12 illustrates an embodiment of a side elevation view of the portable pool table system with a ping pong tabletop.

FIG. 12 illustrates an embodiment of a side elevation view of the portable pool table system 100 with a ping pong table top 1200. In an embodiment, the cover 1100 may be converted into a ping pong table top 1200. The cover 1100 includes attachment mechanisms 1202 such as latches or snaps to attach poles 1204 for a ping pong net. The cover top comprises a high-density fiberboard with markings for ping pong play. In another embodiment, another specialty cover is implemented for the ping pong table top 1200, and the specialty cover includes the high-density fiberboard with markings for ping pong play. Another weatherproof cover is used for transport and storage of the trailer 102.

Figure 13:
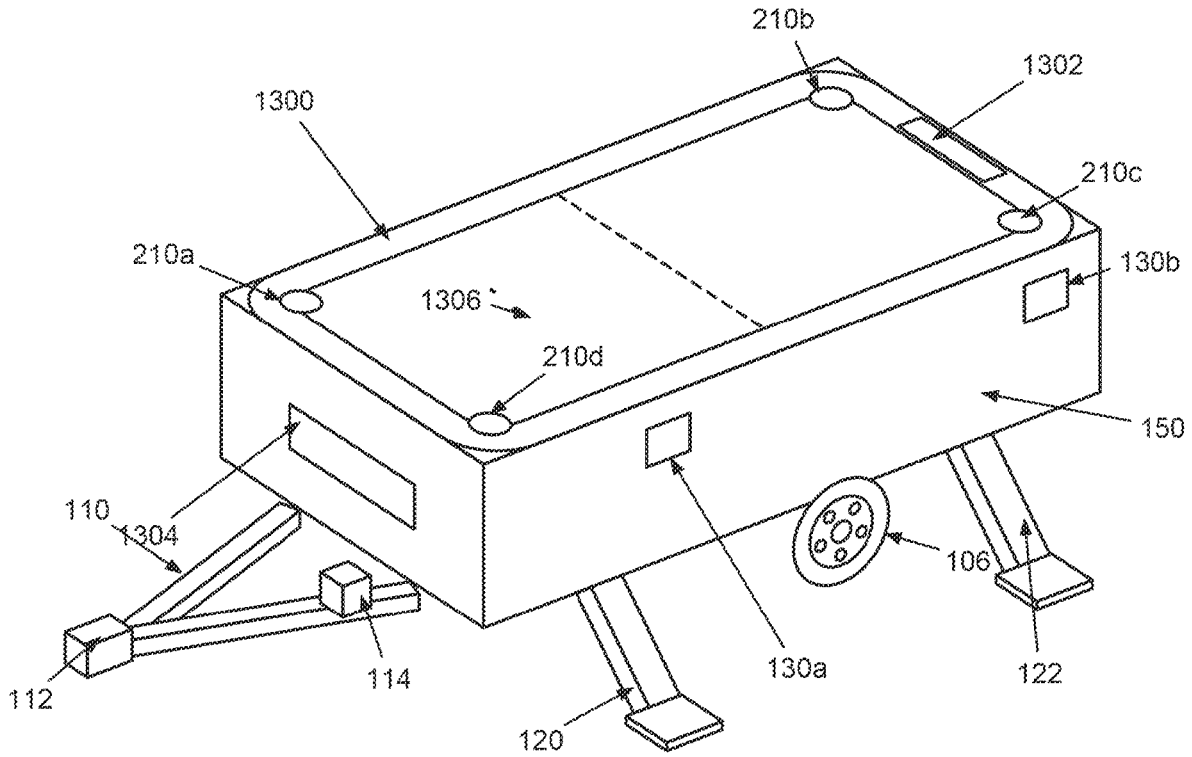
FIG. 13 illustrates an embodiment of a side elevation view of a portable air hockey table with a leveling system.

FIG. 13 illustrates an embodiment of a side elevation view of a portable air hockey table 1300 with a leveling system. The air hockey table 1300 includes a slit 1302 for sliding the disc to win a point and one or more disc returns 1304. The air hockey table 1300 includes air blown through small air holes on the playing surface 1306 (not shown) by an air flow system (not shown).

The leveling system for the air hockey table 1300 is similar as with the pool table system 100. The trailer 102 includes two adjustable support legs 120, 122 that are configured to extend from the bottom of the trailer 102. One or more level indicators 210*a-d* are located on the table top 1300 and may be referenced when adjusting the length of the support legs 120, 122. After extension of the support legs 120, 122, the wheels 106 may be elevated off the ground or may remain touching the ground but with little to no rotation. Though two support legs 120, 122 are shown in FIG. 13 as an example embodiment, four support legs may be implemented or a single central column may be implemented instead.

The box support 150 also includes a plurality of leveling mechanisms 400 that are accessible through openings 130*a*, 130*b*. The leveling mechanisms 400 are configured to adjust the level of the hockey tabletop 1300 independently of the trailer 102, as explained in further detail hereinabove with respect to the pool tabletop 140. The playing surface 1306 is fixedly coupled to a top support, as shown in FIG. 4. The top support 408 for the playing surface 1306 is coupled to a bottom support 412 via one or more level mechanisms 400. The level mechanism 400 adjusts the distance between the top support 408 and the bottom support 412 to level the playing surface 1306.

Thus, the trailer 102 may include a pool tabletop 140, a ping pong tabletop 1200 or air hockey tabletop 1300. Other types of table games may be implemented using similar components as described herein, such as shuffleboard or other table games.

Figure 14:
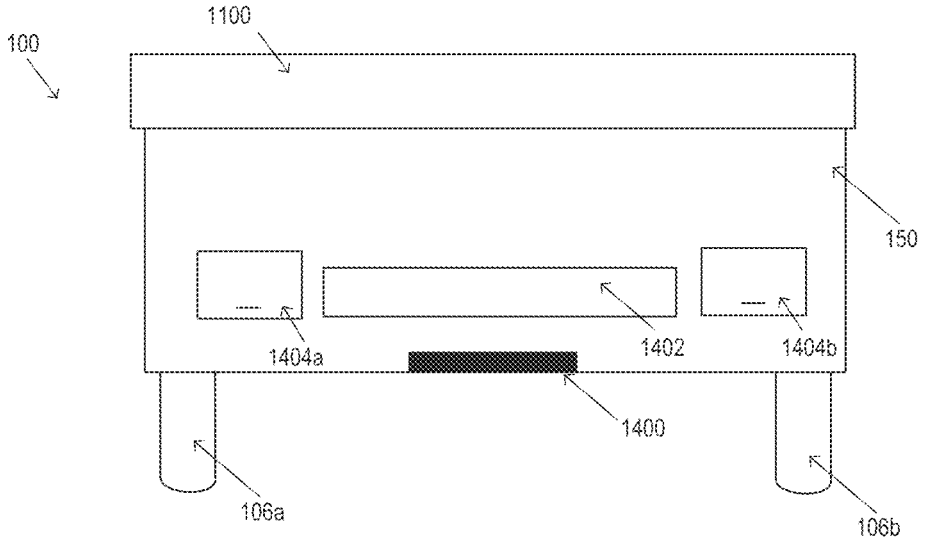
FIG. 14 illustrates an embodiment of a back elevation view of a portable pool table system.

FIG. 14 illustrates an embodiment of a back elevation view of the portable pool table system 100. In this example, the support legs 120, 122 are retracted under the trailer 102 and the tires 106*a*, 106*b* are supporting the trailer 102. The cover 1100 is also installed on the box support 150.

In an embodiment, a back portion of the trailer 102 may include an arm and hitch 1400 for towing other trailers, such as a bar-b-que trailer or another gaming trailer. The back portion of the trailer 102 may also include a shelf 1402 or rack for holding other items during transport, such as a cooler, small refrigerator, bar-b-que, bicycle, etc. For example, a barbeque trailer may have one or two axles and couple to the arm and hitch 1400. When not in motion, the barbeque trailer may be unhitched and retractable support legs are extended to support the barbeque.

The box support 150 may also include one or more drawers or compartments 1404, 1404*b* for holding gaming supplies or other items. Thus, the trailer 102 may include one or more racks, shelves, hitches, drawers, compartments, etc. for holding and stowing other items.

Figure 15:
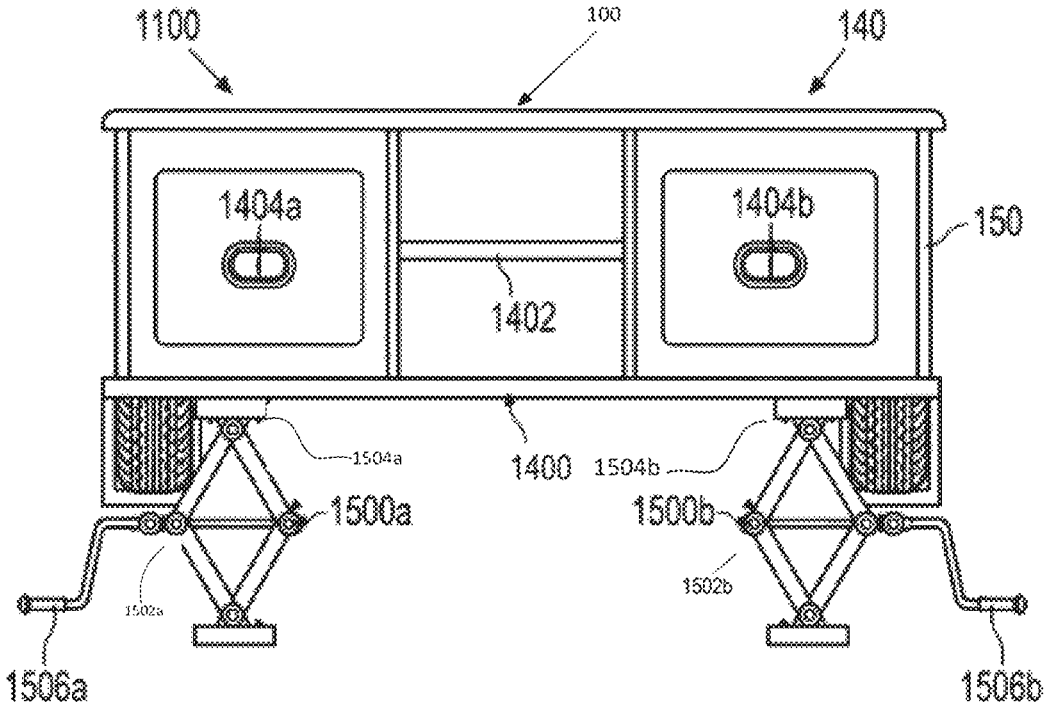
FIG. 15 illustrates an embodiment of support legs for a portable pool table system.

FIG. 15 illustrates an embodiment of a back elevation view of the portable pool table system 100. In this example, the pool table system 100 includes a plurality of support legs 1500*a-b*. For example, the pool table system 100 may include four support legs positioned near each corner. An additional fifth support leg 1500 may be positioned approximately in a center of the pool table, or additional or fewer support legs 1500*a-b* may be implemented.

Each of the support legs 1500*a-b* include a hinge 1504*a-b* for hinging attachment to the trailer 102 or to the bottom supports of the table itself. The support legs 1500*a-b* may be retracted under the trailer 102 using the hinges 1504*a-b* during movement such that the wheels 106 support the trailer. In addition, the height of one or more of the support legs 1500*a-b* may be separately and independently adjusted. For example, all the support legs may be separately and independently adjusted or two support legs on opposing sides, etc.

In one embodiment, the one or more of the support legs 1500*a-b* may include a scissor jack type mechanism with a center bolt 1502*a-b* for adjusting the height, e.g., using the handles or levers 1506*a-b*. In another embodiment, hydraulic jacks may be used in one or more of the support legs 1500*a-b*. The height of the one or more support legs 1500*a-b* may thus be adjusted to level the tabletop 140.

In one embodiment, the pool table 104 may be detachable from the trailer 102 such that the trailer 102 and/or pool table may be used separately. In this embodiment, the support legs 120, 122 are attached to the box support 150 rather than the trailer 102. In another embodiment, the pool table system 100 has an integrated trailer 102, with the axles, wheels, and hitch fixedly attached to the box support 150.

The gaming table as described herein is thus easily transported between locations via the trailer 102 and installed using the adjustable support legs and level mechanisms. The gaming table may be used at parties, gaming tournaments, outdoor camping, tailgating, etc.

As may be used herein, the term "operable to" or "configurable to" indicates that an element includes one or more of components, attachments, circuits, instructions, modules, data, input(s), output(s), etc., to perform one or more of the described or necessary corresponding functions and may further include inferred coupling to one or more other items to perform the described or necessary corresponding functions. As may also be used herein, the term(s) "coupled", "coupled to", "connected to" and/or "connecting" or "interconnecting" includes direct connection or attachment between components or indirect connection between components via an intervening item (e.g., an item includes, but is not limited to, a component, structure, material, etc.). As may further be used herein, inferred connections (i.e., where one element is connected to another element by inference) includes direct and indirect connection between two items in the same manner as "connected to". As may be used herein, the terms "substantially" and "approximately" provides an industry-accepted tolerance for its corresponding term and/or relativity between items.

The various features of the disclosure described herein can be implemented in different systems and devices without departing from the disclosure. It should be noted that the foregoing aspects of the disclosure are merely examples and are not to be construed as limiting the disclosure. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

In the foregoing specification, certain representative aspects of the invention have been described with reference to specific examples. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described. For example, the components and/or elements recited in any apparatus claims may be assembled or otherwise operationally configured in a variety of permutations and are accordingly not limited to the specific configuration recited in the claims.

Furthermore, certain benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a nonexclusive inclusion, such that a process, method, article, composition, or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied, or otherwise particularly adapted to specific environments, manufacturing specifications, design parameters, or other operating requirements without departing from the general principles of the same.

Moreover, reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is intended to be construed under the provisions of 35 U.S.C. § 112(f) as a "means-plus-function" type element, unless the element is expressly recited using the phrase "means for" or, in the case of a method claim, the element is recited using the phrase "step for."

The invention claimed is:

1. A portable gaming system, comprising:
- a gaming table including a tabletop;
- a trailer attached to the gaming table, wherein the trailer includes:
  - at least one axle and two wheels;
  - a hitch; and
  - a plurality of supports, wherein a height of one or more of the plurality of supports is adjustable for leveling the tabletop of the gaming table;
- a bottom support for the gaming table, wherein the bottom support is coupled to the trailer;
- a top support fixedly coupled to the tabletop; and
- a plurality of level mechanisms for leveling the tabletop, the plurality of level mechanisms couple the top support and the bottom support, wherein each of the plurality of level mechanisms is separately adjustable to increase or decrease a distance between the top support and the bottom support.

2. The portable gaming system of claim 1, wherein the plurality of leveling mechanisms is configured to adjust a level of the tabletop independently of the trailer, and wherein the plurality of leveling mechanisms is selected from the group consisting of a bolt system and a hydraulic lift system.

3. The portable gaming system of claim 1, further comprising a flexible layer positioned between the top support and the tabletop to accommodate leveling adjustments.

4. The portable gaming system of claim 3, wherein the bottom support for the gaming table is detachably coupled to the trailer.

5. The portable gaming system of claim 3, wherein each of the plurality of level mechanisms comprises:
- a bolt with threads reversed from each end, wherein the bolt pulls a portion of the top support a closer distance to the bottom support when rotated in a first direction and pushes the portion of the top support a further distance from the bottom support when rotated in a second direction.

6. The portable gaming system of claim 2, comprising:

a plurality of level indicators positioned on the tabletop, wherein the plurality of level indicators is used to determine a level for the tabletop when adjusting the plurality of level mechanisms and the height of the one or more of the plurality of supports.

7. The portable gaming system of claim 1, wherein the hitch is integrated with a crossbar attached to the trailer, wherein the hitch is configured to attach to a vehicle for towing of the trailer.

8. The portable gaming system of claim 1, wherein the trailer includes a track for sliding the hitch under the trailer.

9. The portable gaming system of claim 1, wherein the tabletop includes at least one of: a pool tabletop, air hockey tabletop or a shuffle board tabletop.

10. The portable gaming system of claim 6, further comprising:

a level controller including at least one processing circuit and at least one memory device, wherein the at least one memory device stores instructions that, when executed by the at least one processing circuit, causes the portable gaming system to:

determine level data from the plurality of level indicators; and automatically adjust one or more of the plurality of level mechanisms and/or the height of the one or more of the plurality of supports in response to the level data.

11. The portable gaming system of claim 6, further comprising a trailer hitch on a back portion of the trailer for attaching to a vehicle.

12. The portable gaming system of claim 1, wherein the plurality of supports comprises:

at least four legs, wherein each one of the four legs includes a scissor jack for independently raising and lowering a height of the respective one of the four legs.

13. The portable gaming system of claim 1, wherein the plurality of supports comprises:

at least two legs, wherein each one of the two legs is hingedly coupled to the trailer and independently extendable to different heights.

14. A portable gaming system, comprising:

a gaming table including a tabletop and box support;

at least two wheels coupled to the box support;

a hitch coupled to the box support; and a plurality of adjustable legs coupled to the box support, wherein the plurality of adjustable legs are separately adjustable for leveling the tabletop of the gaming table;

a bottom support, wherein the bottom support is coupled to the plurality of adjustable legs;

a top support fixedly coupled to the tabletop;

a plurality of level mechanisms for leveling the tabletop, the plurality of level mechanisms that couple the top support and the bottom support, wherein each of the plurality of level mechanisms is separately adjustable to increase or decrease a distance between the top support and the bottom support.

15. The portable gaming system of claim 14, wherein the plurality of leveling mechanisms are configured to adjust a level of the tabletop independently of the trailer, and wherein the plurality of leveling mechanisms comprise at least one of a bolt system, a hydraulic lift system, or a gear system.

16. The portable gaming system of claim 1, further comprising a flexible layer positioned between the top support and the tabletop to accommodate leveling adjustments.

17. A portable gaming system, comprising:

a gaming table including a tabletop and box support, wherein the box support includes:

a top support fixedly coupled to the tabletop;

a bottom support; and a plurality of level mechanisms that couple the top support and the bottom support, wherein each of the plurality of level mechanisms is separately adjustable to increase or decrease a distance between the top support and the bottom support; and a vehicular trailer attached to the box support, wherein the trailer includes:

at least one axle and two wheels;

a hitch; and a plurality of adjustable legs, wherein the plurality of adjustable legs is each separately adjustable for leveling the tabletop of the gaming table.

18. The portable gaming system of claim 17, wherein the plurality of adjustable legs comprises:

at least four legs, wherein each one of the four legs includes a scissor jack for independently raising and lowering a height of the respective one of the four legs.

19. The portable gaming system of claim 17, wherein the plurality of adjustable legs comprises:

at least two legs, wherein each one of the two legs is hingedly coupled to the trailer and independently extendable to different heights.

20. The portable gaming system of claim 19, further comprising:

a plurality of level indicators positioned on the tabletop, wherein the plurality of level indicators measures a level of the tabletop for adjusting the plurality of level mechanisms and the plurality of adjustable legs.

* * * * *